US008875632B2

(12) United States Patent
Jaehnichen

(10) Patent No.: US 8,875,632 B2
(45) Date of Patent: Nov. 4, 2014

(54) METHOD OF MANUFACTURING COLORED SHOT FOR SHOT SHELLS

(71) Applicant: Tony Jaehnichen, Felton, CA (US)

(72) Inventor: Tony Jaehnichen, Felton, CA (US)

( * ) Notice: Subject to any disclaimer, the term of this patent is extended or adjusted under 35 U.S.C. 154(b) by 0 days.

(21) Appl. No.: 13/749,738

(22) Filed: Jan. 25, 2013

(65) Prior Publication Data

US 2014/0208974 A1 Jul. 31, 2014

(51) Int. Cl.
*F42B 7/04* (2006.01)
*F42B 12/76* (2006.01)
*F42B 12/80* (2006.01)

(52) U.S. Cl.
CPC ..... *F42B 7/046* (2013.01); *F42B 12/80* (2013.01); *F42B 12/76* (2013.01); *F42B 7/04* (2013.01)
USPC ..... 102/459; 102/448; 102/501; 86/57; 86/54

(58) Field of Classification Search
CPC ..... F42B 7/04; F42B 7/046; F42B 12/74; F42B 12/76; F42B 12/80
USPC ..... 102/458, 459, 448, 457, 460; 86/57, 54
See application file for complete search history.

(56) References Cited

U.S. PATENT DOCUMENTS

| | | | | |
|---|---|---|---|---|
| 2,919,647 | A * | 1/1960 | Dear et al. | 102/459 |
| 5,528,988 | A * | 6/1996 | Lindgren et al. | 102/459 |
| 5,747,724 | A * | 5/1998 | Lindgren et al. | 102/459 |
| 6,189,454 | B1 * | 2/2001 | Hunt | 102/444 |
| 7,426,888 | B2 | 9/2008 | Hunt | |
| 7,823,495 | B2 | 11/2010 | Martini Filho | |
| 8,146,505 | B2 | 4/2012 | Huffman | |
| 8,158,433 | B2 | 4/2012 | Welle | |
| 8,561,542 | B2 * | 10/2013 | Authement, Sr. | 102/459 |
| 2001/0008107 | A1 * | 7/2001 | Hunt | 102/444 |

FOREIGN PATENT DOCUMENTS

| | | | |
|---|---|---|---|
| GB | 757645 | A * | 9/1956 |
| GB | 2209065 | A * | 4/1989 |

* cited by examiner

*Primary Examiner* — James Bergin

(57) ABSTRACT

A method for providing permanently colored steel shot for shot shells through anodizing and shells manufactured utilizing the shot.

3 Claims, 1 Drawing Sheet

METHOD OF MANUFACTURING COLORED SHOT FOR SHOT SHELLS

BACKGROUND OF THE INVENTION

This invention deals with shot shells that are useful for bird hunting. When hunting wild birds, such as pheasants, quail, ducks, partridge, and the like, it is often the situation where there is more than one hunter present. Typically, birds are hunted by casually walking through woods, fields, or in the case of ducks, in marshes and the like. Whenever a bird arises, typically more than one hunter is close enough to shoot at the bird and therefore, the bird might be hit by one or more hunters. The problem is always how one determines who actually shot the bird and therefore, who gets to keep the game.

A most modern subject in the field of hunting is to use colored shot in shot shells in order to determine who actually shot the game so that the actual shooter can claim such game, and, to identify the gauge of the shell on sight, said colored shot being prior art enameled shot.

Attempts have been made to provide modified ammunition for tracking wounded prey as found in U.S. Pat. No. 7,426,888, that issued to Hunt. That patent discloses ammunition in which the cartridge is equipped with a tracer agent which is part of the ammunition.

U.S. Pat. No. 7,823,495, that issued to Filho deals with a process for manufacturing tracking ammunition which contains labels for easy tracking and U.S. Pat. No. 8,146,505 to Huffman, deals with a projectile that has an outer casing that contain a marking material that unseals upon impact and allows the marking material to disperse.

Finally, U.S. Pat. No. 8,158,433 deals with a fragmented taggant coding system for tagging ammunition which uses an isotopic taggant.

None of these devices utilizes a colored shot for shot shells and none of these references provides a process for putting a permanent coloring onto shot for shot shell use.

THE INVENTION

Thus what is disclosed and claimed herein is a method of providing permanently colored shot for shot shells, the method comprising providing a predetermined size of steel shot and anodizing the steel shot to a predetermined color.

In another embodiment, the invention provides for shot shells manufactured utilizing the shot prepared by the process described just Supra.

In yet another embodiment, the shot shell comprises a container for shot shell components; a brass base having a bottom fixedly attached to one end of said container, said bottom having a centered opening therein, said brass base having a shot shell primer fitted in said opening; sufficient gunpowder contained in the container to throw shot; a wad laying over said powder; sufficient anodized colored steel shot laid over the powder wad, and, a wad laid over the shot, wherein the end of the container opposite the brass base end is closed to contain the contents of the shot shell.

DETAILED DESCRIPTION OF THE INVENTION

Figure 1:
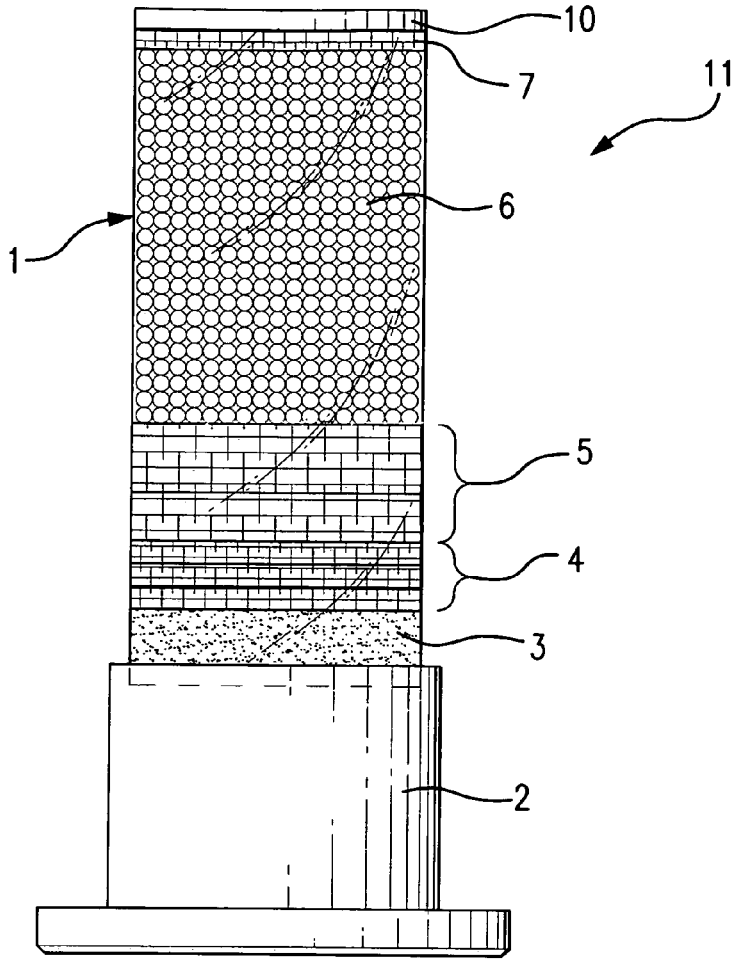
FIG. 1 is a full view of a shotgun shell of this invention.
Figure 2:
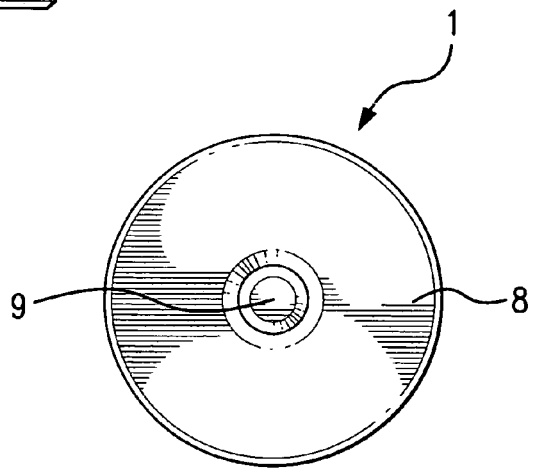
FIG. 2 is a full bottom view of a shotgun shell of this invention.

A shotgun shell of this invention is a self-contained cartridge loaded with multiple steel shot that is colored. FIG. 1 shows a shot shell in which the container 1 for the components is transparent so that one can see into the interior of the shell. Thus, there is shown the shotgun shell 11, the brass base 2, the gunpowder 3, the over-powder wad 4, the shot wad 5, the colored steel birdshot 6, and an over-shot wad 7 and the crimp 10 on the container. Shown in FIG. 2 is the bottom 8 of the brass base 2, also showing the primer 9 that when struck, fires the powder in the shot shell.

Using a transparent plastic container for the components allows for visibility of the shot inside. Shot that is colored can thus be matched with a particular gauge of shell, namely, for example, 12 gauge=green; 16 gauge=blue; 20 gauge=red; 10 gauge=black; 8 gauge=yellow, and 410 gauge=purple. With this in mind, the hunter will be able, at first sight, to choose the correct shot shell for the weapon that he or she is carrying and not mistake the size.

Anodizing is intended in this invention to provide a permanent color to the steel shot. Those colored shots on the market today that are coated with enamels, or other like materials, used to color them, are susceptible to flaking and deterioration such that over a period of time the color disappears from the shot.

Anodizing is an electrolytic passivation process used to increase the thickness of the natural oxide layer on the surface of metal parts. The process is called "anodizing" because the part to be treated forms the anode electrode of an electrical circuit. Anodizing increases corrosion resistance and wear resistance, and generally, provides better adhesion for paint primers and glues than does the bare metal. Thus, anodizing as a means of coloring shot also means that the shot is made more corrosion resistant.

In addition, it has been found by the inventor herein that even though anodization changes the microscopic texture of the surface of the shot and also changes the crystal structure of the metal near the surface, this means of coloring shot does not cause the shot to be altered with regard to "throwing" a normal pattern when the shot is pushed out of the barrel of the shotgun. The anodization process makes the films generally much stronger and more adherent than most types of paint and metal plating and thus, it is expected that shot shells manufactured using the colored shot of this invention will be storable for long periods of time without deterioration of the shot.

What is claimed is:

1. A shot shell comprising:

i. a container for shot shell components;

ii. a brass base having a bottom fixedly attached to one end of said container, said bottom having a centered opening therein, said brass base having a shot shell primer fitted in said opening;

iii. sufficient gunpowder contained in the container to throw shot;

iv. a wad laying over said powder;

v. sufficient anodized colored steel shot laid over the powder wad, and, vi. a wad laid over the shot, wherein the end of the container opposite the brass base end is closed to contain the contents of the shot shell.

2. A shot shell as claimed in claim 1 wherein the container is transparent.

3. A shot shell as claimed in claim 1 wherein the shot shell size is selected from the group consisting of: 12 gauge.

* * * * *